US005454382A

United States Patent [19]

Tariah et al.

[11] Patent Number: 5,454,382

[45] Date of Patent: Oct. 3, 1995

[54] ORTHOPAEDIC CAST SOLES

[75] Inventors: Ibim B. Tariah, Christchurch; Michael J. Borroff, Blandford Forum, both of United Kingdom

[73] Assignee: Johnson & Johnson Orthopaedics, Inc., Raynham, Mass.

[21] Appl. No.: 848,765

[22] Filed: Mar. 10, 1992

[30] Foreign Application Priority Data

Dec. 3, 1991 [GB] United Kingdom ..... 9105199

[51] Int. Cl.[6] ..... A61F 5/37; A61F 5/00

[52] U.S. Cl. ..... 128/882; 602/23; 36/11.5

[58] Field of Search ..... 602/1, 5, 6, 7, 602/8, 20, 23, 28, 29; 36/7.5, 7.7, 11.5, 7.6, 59 C, 59 R, 32 R, 110

[56] References Cited

U.S. PATENT DOCUMENTS

| | | | |
|---|---|---|---|
| 1,572,213 | 2/1926 | Lucas | 36/11.5 |
| 2,367,232 | 1/1945 | Marx | 36/11.5 |
| 2,932,911 | 4/1960 | Musebeck | 36/11.5 |
| 2,957,253 | 10/1960 | Meltzer | 36/11.5 |
| 3,275,002 | 9/1966 | Scholl | 36/11.5 |
| 4,446,633 | 5/1984 | Scheinhaus | 36/11.5 |
| 4,777,738 | 10/1988 | Giese | 36/32 R |
| 4,817,302 | 4/1989 | Saltsman | 36/11.5 |
| 4,843,736 | 7/1989 | Courian | 36/11.5 |
| 4,869,000 | 9/1989 | York | 36/11.5 |
| 5,056,241 | 10/1991 | Young | 36/11.5 |

FOREIGN PATENT DOCUMENTS

| | | | |
|---|---|---|---|
| 0284361 | 9/1988 | European Pat. Off. . | |
| 0509225 | 1/1955 | Italy | 36/59 C |

*Primary Examiner*—Michael A. Brown

[57] ABSTRACT

This invention relates to a sole for an orthopaedic cast having an upper and a lower surface and first, second and third regions broadly corresponding respectively to the heel, arch of the foot and ball of the foot of a wearer, characterized in that the lower surface of the third region is provided with two crossed oblique recesses. Preferably the shape of the sole, and location of the first and second recesses are such that the sole is substantially congruent with its mirror image. The sole is attached to an orthopaedic cast by a source of, inter alia, a strap which passes through one oblique recess, and which is fastened over the top of the cast. In this way, the strap extends from a posterior region of the ball of the wearer's foot on the side corresponding to the small toe to an anterior region thereof on the side corresponding to the big toe.

17 Claims, 2 Drawing Sheets

FIG. 3
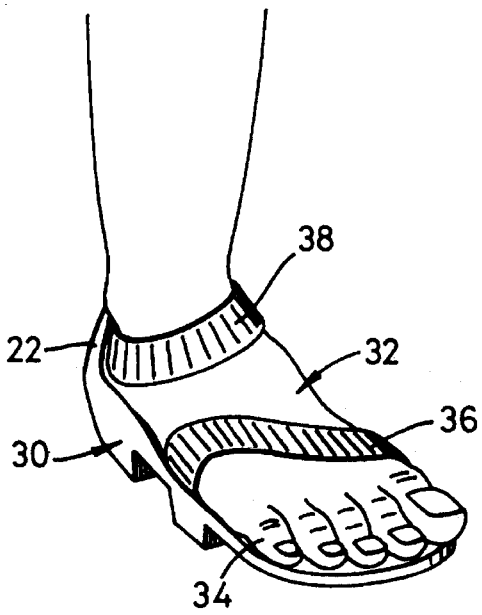
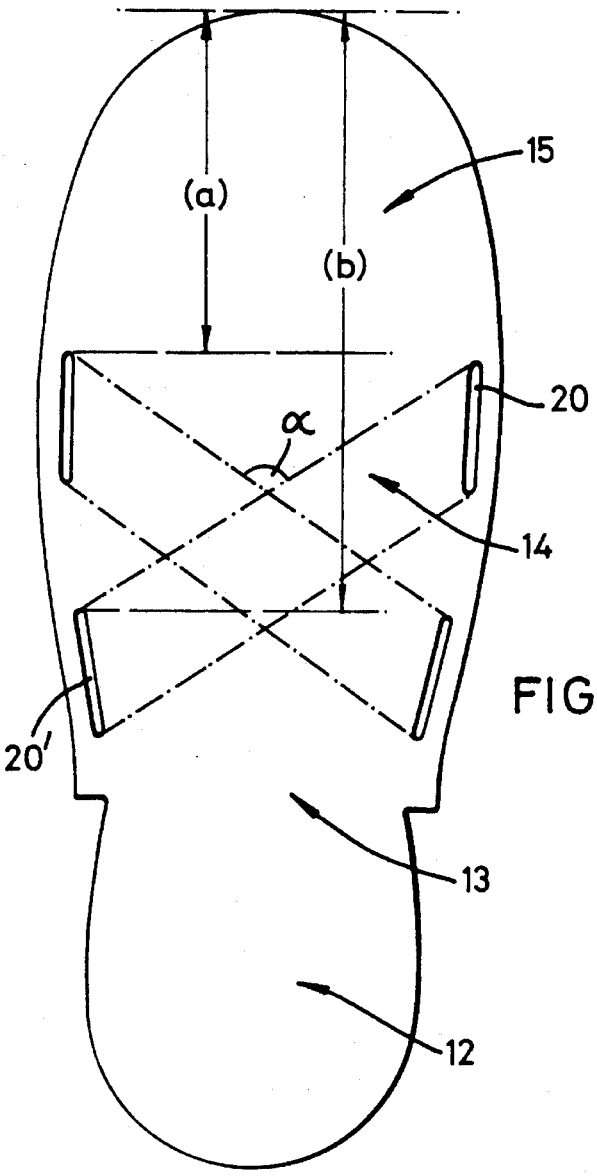
FIG. 4

ORTHOPAEDIC CAST SOLES

This invention relates to a sole for an orthopaedic cast.

Orthopaedic cast soles are known, for example, from our U.K. patent no. GB-B-2098455, which discloses a sole or flexible overshoe comprising a main body portion carrying treads on its lower surface in the regions of the heel and ball of the foot of the wearer. The sole is retained on the lower surface of the cast by means of a recess or groove on its upper surface for co-operation with a projection on the lower surface of the cast, and by means of a strap or straps passing through slots and/or transverse recesses in the heel and/or ball of the foot regions and over the top of the cast.

Other methods of attaching a sole to an orthopaedic cast have been proposed as, for example, in our European patent application no. 88302529.8, published as EP-A-0284361 in which a sole is disclosed, provided on either side with flexible uppers. The uppers are folded around the cast, and attached over the top of the cast by means, for example, of a thistle-cloth fastener such as VELCRO (Trade Mark).

Both the above arrangements, however, suffer from the disadvantage that it is easy, upon application of the sole, for the small toe of the wearer to be pushed in towards the remaining toes by the straps in the ball of the foot region, or by the overlapping uppers. Such small toe entrapment is highly counter-productive in, for example, fracture management, since it may result in complications such as skin laceration, poor circulation or even loss of function. It is also very uncomfortable for the patient who may have to discontinue wearing the sole.

The present invention seeks to provide a sole for an orthopaedic cast with which the likelihood of small toe entrapment is substantially reduced. In the following, the terms "anterior", posterior", "left", "right", etc. shall be understood in the normal anatomical sense with reference to a wearer of an orthopaedic cast to which the sole of the present invention is to be attached.

Thus, according to the invention there is provided a sole for an orthopaedic cast having an upper and a lower surface and first, second and third regions broadly corresponding respectively to the heel, arch of the foot and ball of the foot of a wearer, characterised in that the lower surface of the third region is provided with a first oblique recess running from adjacent the left-hand edge of an anterior portion thereof to adjacent the right-hand edge of a posterior portion and a second oblique recess running from adjacent the right-hand edge of the anterior portion to adjacent the left-hand edge of the posterior portion.

Preferably, the oblique recesses are of a dove-tail section, to prevent the strap from becoming dislodged accidentally and minimise abrasion during walking. In that case, it is preferred that the sides of each recess enclose an angle of about 60°.

Preferably the shape of the sole, and location of the first and second recesses are such that the sole is substantially congruent with its mirror image.

Preferably, the lower surfaces of the first and third regions are provided with treads.

The sole of the present invention is attached to an orthopaedic cast by means of, inter alia, a strap which passes through either the first oblique recess, in the case where the cast is on the wearer's right foot, or the second oblique recess, in the case where the cast is on the wearer's left foot, and which is fastened over the top of the cast, for example by thistle-cloth. In this way, the strap, when passing over the top of the cast, extends from a position just posterior of the patient's small toe on the lateral side of the foot to a position just posterior of the patient's big toe on the medial side thus substantially avoiding any pressure being put on the small toe.

An advantage of shaping the sole, and positioning the recesses in such a way that the sole is substantially congruent with its mirror image is that the sole can be used on either the wearer's left or right foot with no substantial difference in characteristics. It also enables fracture management centres, for example, to maintain a smaller stock of soles in the knowledge that they can easily cater for both left and right cast applications and enables the manufacturer to reduce tooling-up costs.

Preferably, each end of each oblique recess is in communication with a slot running from the lower to the upper surface of the sole. Each slot may consist of an indentation in the edge of the sole, but it is preferred that each slot consists of a hole passing from the lower to the upper surface adjacent the edge of the sole. The slots help to locate the fastening strap in their corresponding oblique recess and, in the case where the slots consist of holes, serve to retain the strap in the sole when not fastened over the top of a cast.

Advantageously, the sole may further comprise a fourth region broadly corresponding to the toes of the wearer. In a preferred embodiment of the present invention, the fourth region is not provided with a tread on its lower surface, and consists of sufficiently soft, resilient material for it easily to be cut manually by means of a knife or scissors. This feature of the invention caters for those occasions where the wearer requires freedom to move his toes completely and independently of the sole for example in exercising his toes when not walking.

Conveniently, the sole may include a recess or groove in its upper surface to aid in its attachment to and retainment on a cast. The recess or groove may be central and elongate to enable the sole to be attached to the cast by filling the recess or groove with adhesive and sticking it to the cast.

However, even if the sole is not attached to the lower surface of the cast by an adhesive, the recess or groove is useful in that it enables the cast to be formed in its final stages while the sole is attached thereto so that a projection is formed on the lower surface of the cast to engage and locate the sole each time it is fastened onto the cast.

The sole may also include a stiffening member, e.g. a metallic plate embedded therein, to impart greater rigidity to the sole.

Advantageously, the fourth region of the sole may be thinner, i.e. of smaller dimension measured in a direction from the lower to the upper surface, than the remaining regions to enable it easily to be removed if it is not required or if it is necessary to shorten it for a particular wearer. Resilience of the fourth region ensures that it is not possible to transfer the wearer's entire weight through the anterior end of the fourth region. This alleviates any problems associated with the sole cracking under stress.

Preferably, the sole is formed of a single moulding of a resilient rubber, plastics material or alloys thereof, for example polyurethane, polyester, PVC polymers, elastomers, thermoplastic elastomers and alloys thereof.

Advantageously, the posterior end of the first region of the sole is provided on its upper surface with a generally upstanding heel-engaging flange, broadly corresponding to the lower portion of the wearer's achilles tendon. This flange is preferably provided with a plurality of slots or holes for locating and/or retaining further fastening straps for fastening around the ankle region of the cast.

The sole may also be provided with slots or holes adjacent either edge of the second region for locating and/or retaining yet further fastening straps, the second region not being provided with a tread.

One embodiment of an orthopaedic cast sole according to the present invention will now be described with reference to the accompanying drawings, in which:

FIG. 3 is a perspective view of a sole according to the invention attached to a patient's right foot, in which, for convenience, the cast is not shown; and FIG. 4 is an outline view of a sole according to the invention taken from above.

Figure 1:
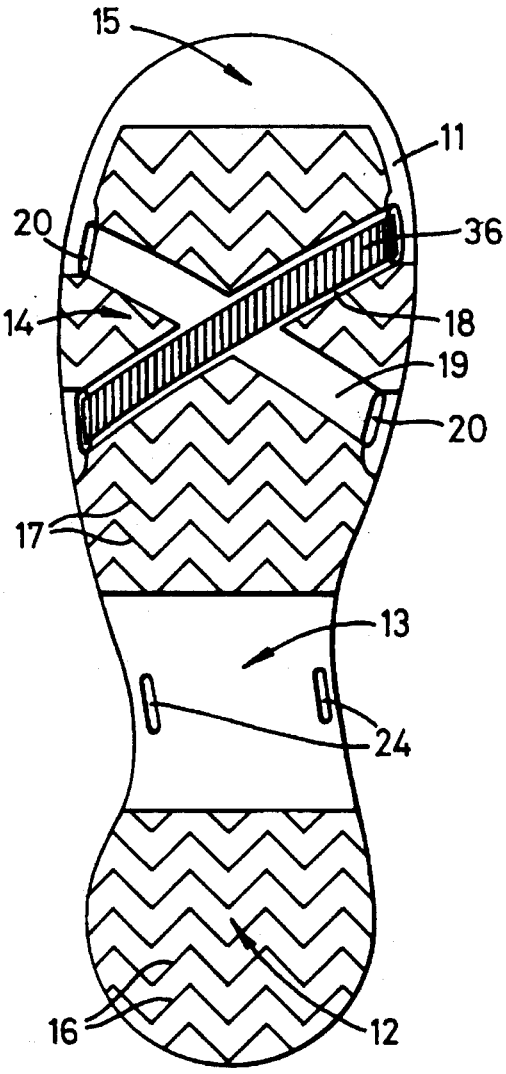
FIG. 1 is a view of the lower surface of a sole according to the present invention.
Figure 2:
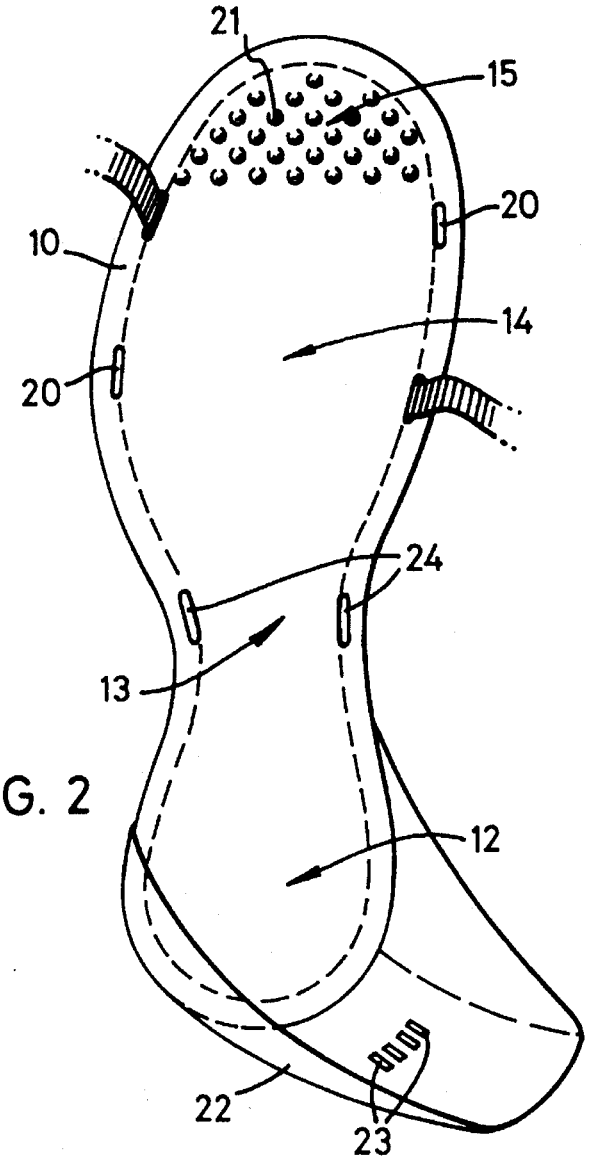
FIG. 2 is a perspective view of the sole of FIG. 1, taken from above.

FIGS. 1 and 2 both illustrate a sole for an orthopaedic cast having an upper (10) and a lower (11) surface and first (12), second (13), third (14) and fourth (15) regions broadly corresponding respectively to the heel, arch of the foot, ball of the foot and toes of a wearer.

As can be seen from FIG. 1, the lower surface of the first (12) and third (14) regions are provided with treads (16, 17). The lower surface of the third region (14) is provided with first (18) and second (19) oblique recesses. A fastening strap is illustrated as located in the first oblique recess (18), and the sole is therefore configured to be attached to a cast on the wearer's right foot.

Each end of each oblique recess (18; 19) of the sole of FIGS. 1 and 2 is in communication with a slot (20), which in this embodiment consists of a hole passing through the sole, from the lower to the upper surface, adjacent the edge of the sole.

The fourth region (15) of the sole, along with the second region (13) is, in this embodiment, not provided with a tread on its lower surface, but is provided with gripping nodules (21) on its upper surface to give the wearer's toes a purchase on the sole. However, the fourth region (15) and any other regions may be otherwise provided with a textured upper surface.

As can be seen from FIG. 2, the posterior end of the first region (12) is provided on its upper surface with a heel-engaging flange (22), broadly corresponding to the lower portion of the wearer's achilles tendon. The flange is provided with a plurality of holes (23) for locating and retaining further fastening straps (not shown).

The sole is also provided with holes (24) adjacent either edge of the second region for locating and retaining a yet further fastening strap (not shown).

As is shown in FIG. 3 and will now briefly be described, the sole (30) according to the invention will normally be attached to a patient's foot (32), or at least to a cast thereon, by means of a strap (36) located in one of the oblique recesses and fastened over the top of the foot, and another strap passing through and located in holes in the heel-engaging flange (22) and fastened around the patient's ankle.

It will be appreciated that, once again, the sole of FIG. 3 is configured to be applicable to the patient's right foot and that, as shown, the fastening strap (36) remains clear of the patient's small toe (34), and indeed remaining toes.

FIG. 4 is included as illustrating various dimensional data relating to the positioning of the slots (20) and oblique recesses (illustrated schematically in phantom). The distance (a) is defined as the perpendicular distance from the foremost point of the sole to a line joining the foremost points of the anterior slots (20). It is envisaged that this distance is preferably in the range 50–95 mm, with optimal distances being 60, 69, 77 and 85 mm for "small" "medium", "large", and "extra large" sizes respectively A similar definition applies mutatis mutandis to distance (b), but for the posterior slots (20'). This distance is preferably in the range 90–165 mm, with optimal distances as above being 106, 120, 133 and 148 mm respectively.

Finally, the angle $\alpha$, defined as the longitudinal angle between the two oblique recesses, is preferably in the range 100°–120° the optimal angles for the four sizes of sole being 114°, 114°, 114° and 108° respectively It will, of course, be understood that the present invention has been described above purely by way of example, and that modifications of detail may be made without departing from the scope of the invention.

We claim:

1. A sole for an orthopaedic cast having an upper and a lower surface and first, second and third regions broadly corresponding respectively to the heel, arch of the foot and ball of the foot of a wearer, characterised in that the lower surface of the third region is provided with a first recess running from adjacent the left-hand edge of an anterior portion thereof across the width of said sole to adjacent the right-hand edge of a posterior portion and a second recess running from adjacent the right-hand edge of the anterior portion to across the width of said sole to adjacent the left-hand edge of the posterior portion, said recesses being of sufficient depth to accept a strap to secure said sole to an orthopedic cast.

2. A sole according to claim 1 which is so shaped, and wherein the first and second oblique recesses are so located, that the sole is substantially congruent with its mirror image.

3. A sole according to claim 1, wherein the lower surfaces of the first and third regions are provided with treads.

4. A sole according to claim 1, wherein each end of each oblique recess is in communication with a slot running from the lower to the upper surface of the sole.

5. A sole according to claim 4, wherein each slot consists of an indentation in the edge of the sole.

6. A sole according to claim 4, wherein each slot consists of a hole adjacent the edge of the sole.

7. A sole according to claim 1, further comprising a fourth region broadly corresponding to the toes of the wearer.

8. A sole according to claim 7, wherein the fourth region is not provided with a tread on its lower surface, and consists of sufficiently soft, resilient material for it easily to be cut manually by means of a knife or scissors.

9. A sole according to claim 7, wherein the fourth region is thinner than the remaining regions of the sole.

10. A sole according to claim 1, further including a recess or groove in its upper surface.

11. A sole according to claim 10, wherein the recess or groove in its upper surface is central and elongate.

12. A sole according to claim 1, formed of a single moulding of a resilient rubber or plastics material or alloys thereof.

13. A sole according to claim 12, wherein the material comprises polyurethane.

14. A sole according to claim 1, wherein the posterior end of the first region is provided on its upper surface with a generally upstanding flange, broadly corresponding to the lower portion of the wearer's achilles tendon.

15. A sole according to claim 14, wherein the flange is provided with a plurality of slots or holes for locating and/or retaining a fastening strap or fastening straps.

16. A sole according to claim 1, further provided with slots or holes adjacent either edge of the second region for locating and/or retaining a fastening strap or fastening straps, the second region not being provided with a tread on its lower surface.

17. A sole according to claim 1, wherein the first and second oblique recesses are of a dove-tail section.

* * * * *